US005421509A

United States Patent [19]

Thuin et al.

[11] Patent Number: 5,421,509

[45] Date of Patent: Jun. 6, 1995

[54] FOLDING BOX

[75] Inventors: Patrice Thuin, Noisy le Grand; Marcel Piquette, Pau, both of France

[73] Assignee: EMBADAC, Morlaas, France

[21] Appl. No.: 199,949

[22] Filed: Feb. 22, 1994

[30] Foreign Application Priority Data

Feb. 25, 1993 [FR] France ..... 93 02156

[51] Int. Cl.[6] ..... B65D 5/36

[52] U.S. Cl. ..... 229/117.07; 229/117.03; 220/408; 220/410

[58] Field of Search ..... 229/117, 117.01, 117.03, 229/117.04, 117.07; 220/408, 410, 415, 416

[56] References Cited

U.S. PATENT DOCUMENTS

| | | | |
|---|---|---|---|
| 1,013,110 | 1/1912 | Beers | 229/117.07 |
| 1,506,137 | 8/1924 | Scruby | 229/117.07 |
| 1,559,240 | 10/1925 | Fox | 229/117.07 |
| 1,671,020 | 5/1928 | Feinberg | 229/117.07 |
| 1,991,347 | 2/1935 | Fairchild | 229/117.04 |
| 2,141,438 | 12/1938 | Hirsch | 229/117.04 |
| 2,271,962 | 2/1942 | Weiner | 229/117.03 |
| 2,833,458 | 5/1958 | Toensmeier | 229/117.07 |
| 4,406,380 | 9/1983 | Paige | 220/416 |
| 4,458,831 | 7/1984 | Lacasa et al. | 220/415 |

FOREIGN PATENT DOCUMENTS

| | | | |
|---|---|---|---|
| 0442552 | 8/1991 | European Pat. Off. . | |
| 133540 | 10/1919 | United Kingdom | 229/117.07 |

*Primary Examiner*—Gary E. Elkins
*Attorney, Agent, or Firm*—Stevens, Davis, Miller & Mosher

[57] ABSTRACT

A folding box having a body with two opposite sides being provided with folding lines (a, b, a', b'), which enable folding this body down flat. The body is combined with a stiffener, the central part (2, 3, 4) of which is adapted so as also to fold down flat on the folded box body. The stiffener has a contour corresponding to that of the bottom of this body so as to match this contour when the stiffener is unfolded in the box body. This folding is applicable to boxes known as "boutique boxes" having a rigid nestable lid.

8 Claims, 3 Drawing Sheets

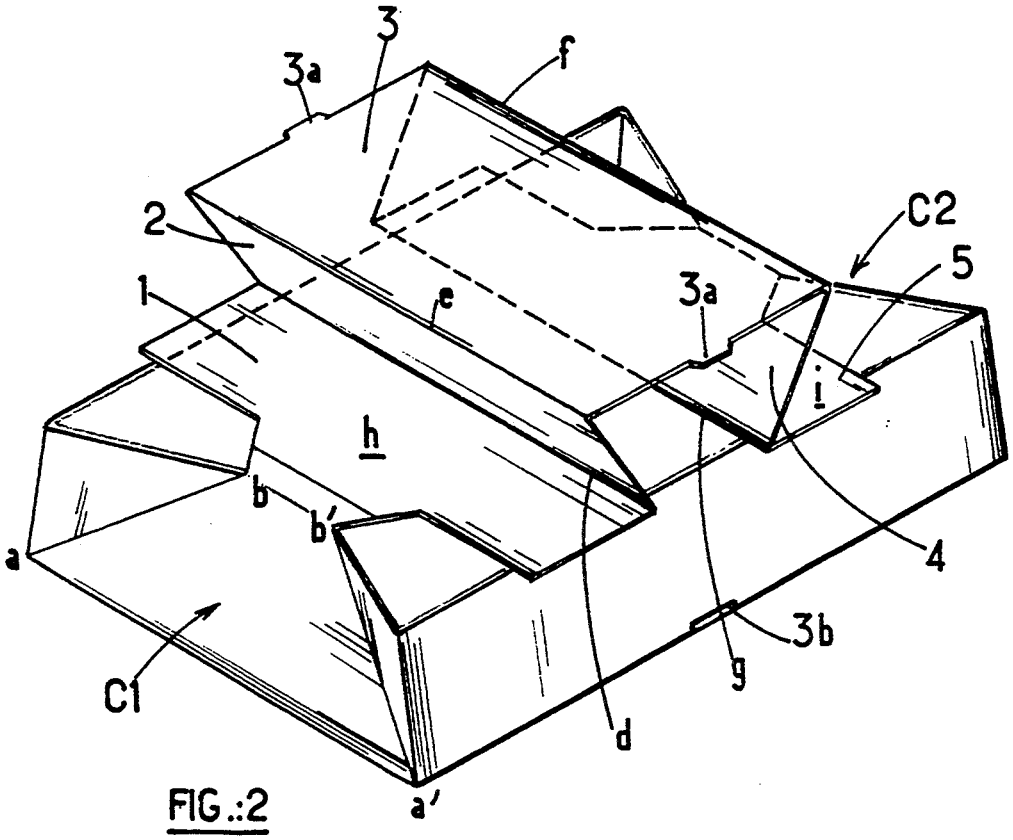
FIG.:2
FIG.:3
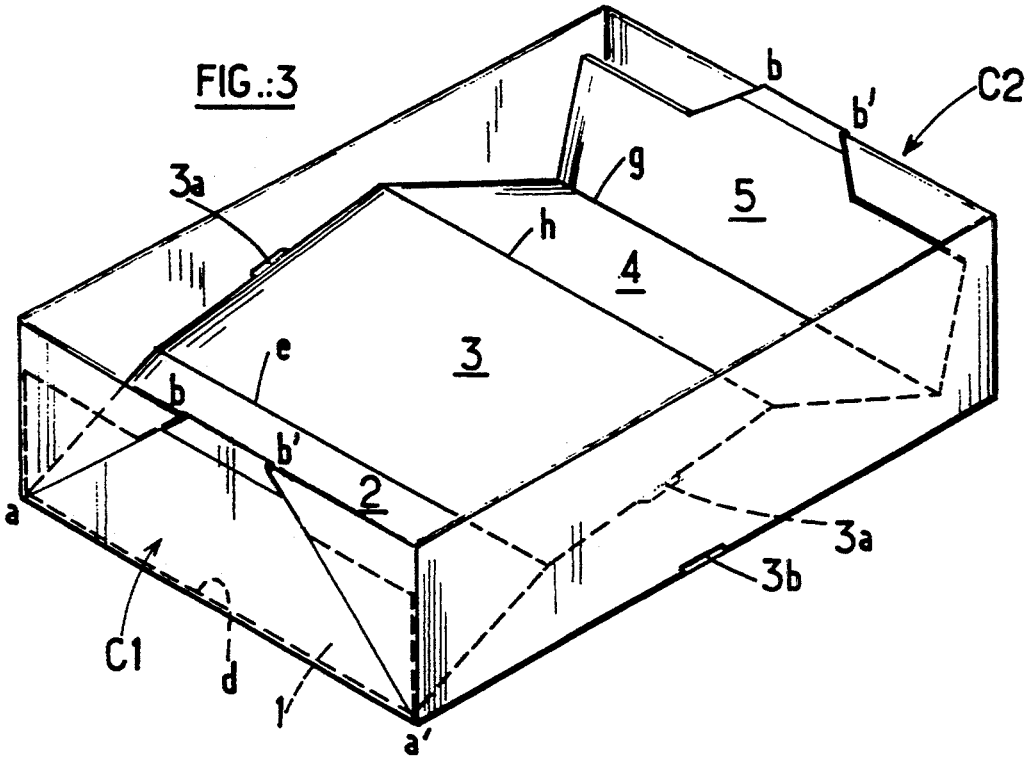

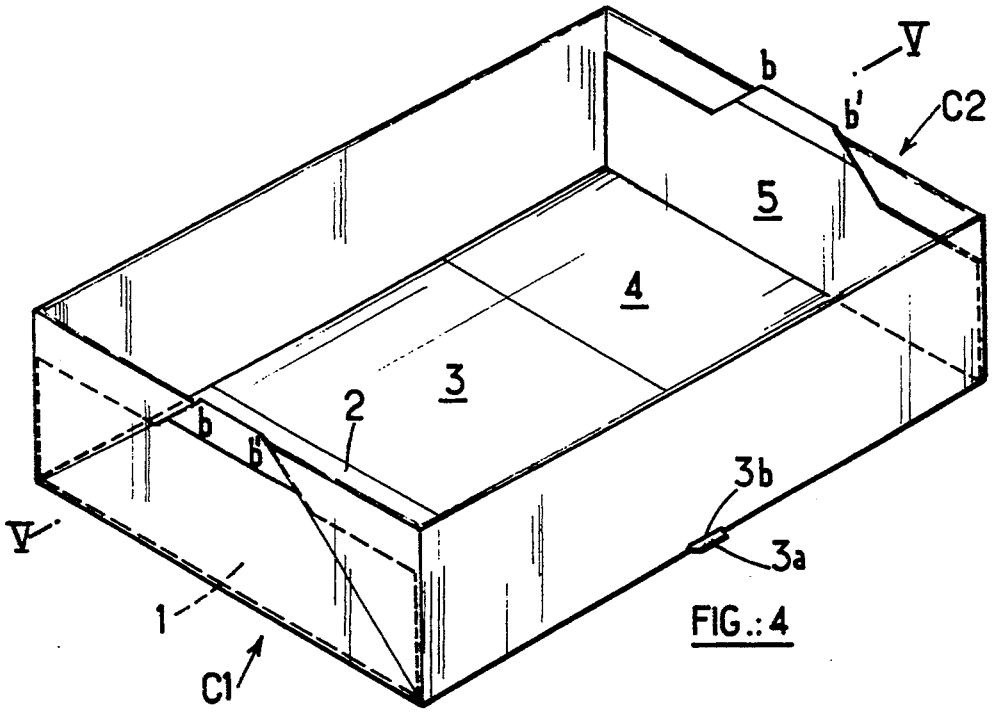
FIG.: 4
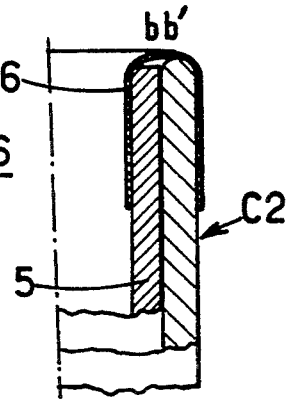
FIG.: 6
FIG.: 5
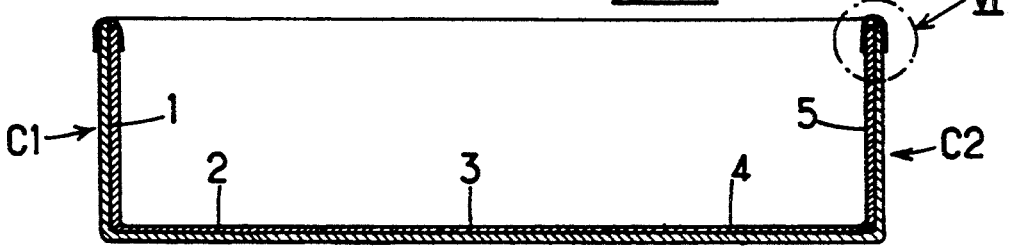

FOLDING BOX

BACKGROUND OF THE INVENTION

Folding boxes made from cardboard or similar semi-rigid thin material, for example plastic, are well known.

Before use, they are offered to the trader, who will use them, in a flat form of small volume, by virtue of the folding-down of the material from which they are made.

However, these boxes, which are in widespread use, for example by confectioners, have no shape stability when they are unfolded and their inelegant appearance is unsuitable for up-market businesses: perfumes, cosmetics, fashion jewellery, etc. In these businesses where aesthetic appearance plays an important role, use has to be made of non-folding boxes known as "boutique boxes", of rectangular parallepipedal shape, having a sufficient volume to contain various articles or products and which lend themselves to various types of decoration. However, these boxes have the drawback that, during storage, they take up a considerable volume. For example, for a customary height of approximately 8 cm, 30 stacked empty boxes will occupy a height of 2.40 m, so that a large stock takes up a great deal of space in a shop where space is limited.

SUMMARY OF THE INVENTION

The box device which is the subject of the invention makes it possible, by virtue of appropriate folding of its constituent parts, to very considerably reduce, for example by two thirds, the storage volume, while providing for use elegant boxes having the stable shapes of "boutique boxes".

This device is characterized in that the cardboard or other material constituting the box body which is equipped on at least two opposite sides with folding lines, which are required for folding this body down flat, is combined with a stiffener which is adapted so as also to fold down flat on the folded box body and has a contour corresponding to that of the bottom of this body so as to match this contour when the stiffener is unfolded in the box body.

Preferably, this stiffener is formed from a thick sheet having the same contour as that of the bottom of the box and may advantageously consist of several panels articulated together.

More preferably, this stiffener is articulated, on the upper edges of two opposite sides of the box body, so as to line and reinforce these two sides as well as the bottom.

The optimum solution is to provide this articulation on the two opposite sides where the lines for folding the box body flat are marked, this favoring stiffening of these two sides after unfolding.

BRIEF DESCRIPTION OF THE DRAWINGS

The following description in respect of the appended drawing, which is given by way of non-limiting example, will clearly elucidate how the invention may be achieved, the particular features which emerge both from the drawing and from the text naturally forming part of the said invention.

FIGS. 2, 3 and 4 similarly illustrate in perspective three successive phases of the unfolding of the box;

FIG. 5 is a longitudinal section of the unfolded box body; and

FIG. 6 is a detailed view on a larger scale.

DETAILED DESCRIPTION OF A PREFERRED EMBODIMENT

Figure 1:
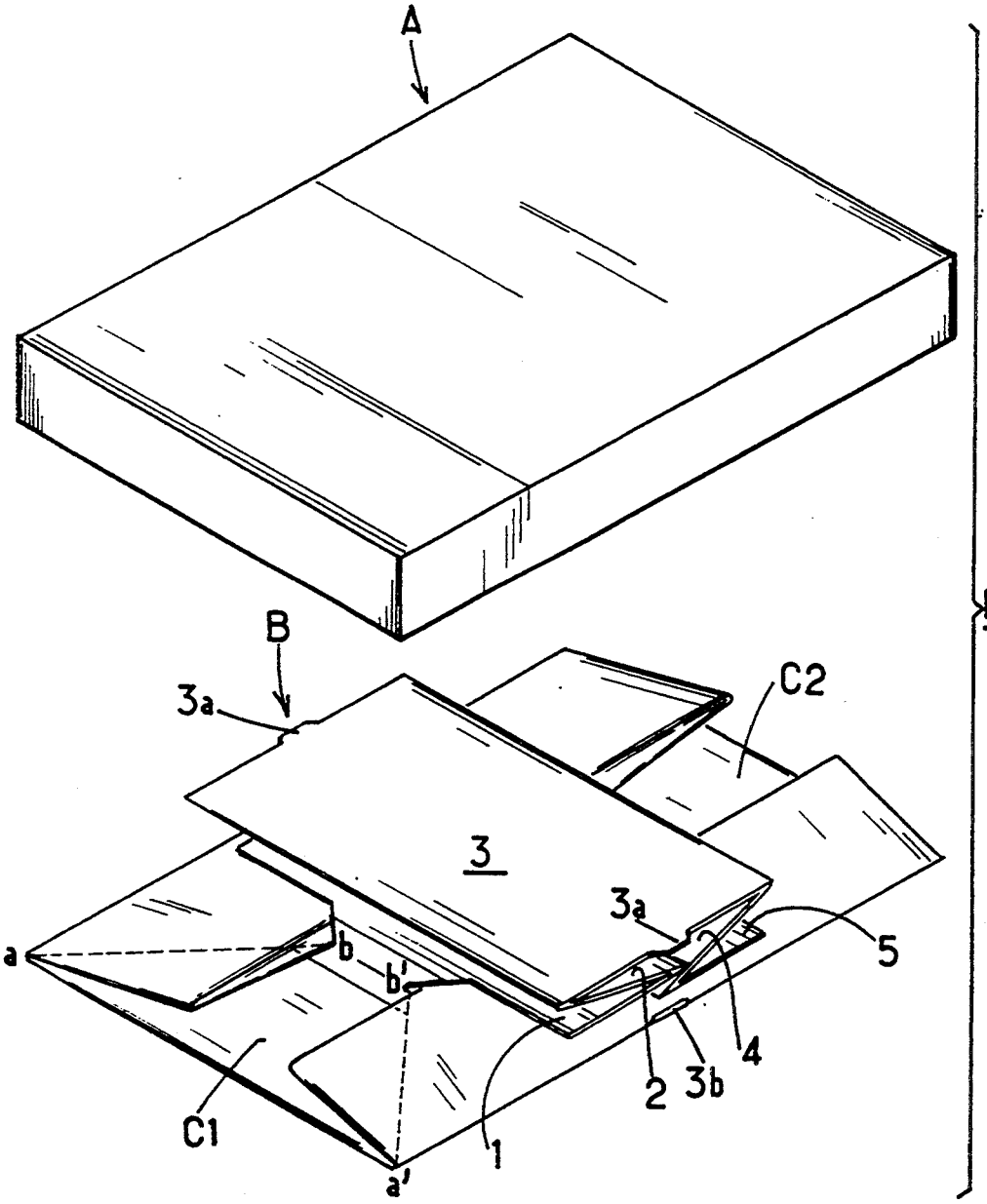
FIG. 1 is a perspective view showing the box in the folded state and its nestable lid.

FIG. 1 shows, on the one hand, the lid A, which is of the nestable type, which may be made from rigid cardboard and bear various types of decoration, and, on the other hand, the box body B in the folded state.

Two of the opposite sides C1 C2 of the box body, which has a rectangular shape, are each equipped with oblique folding lines a b, a'b', which are not concurrent but leave between their upper ends a small straight segment such as b b'. The four sides of the box body are themselves connected to the bottom by fold lines, which makes it possible, as may be understood, to fold the box body down flat into the state shown in FIG. 1.

This box body is associated with a stiffener consisting of a rigid sheet which is equipped with parallel fold lines such as d, e, (see FIG. 2). The central part of the stiffener thus includes a certain number of adjacent articulated panels 2, 3, 4 which, in the folded-down state shown in FIG. 1, are placed flat upon one another, the assembly of these panels being, moreover, such that they are placed in contact with one another in the same plane, they constitute a rectangle which coincides with the rectangle constituting the contour of the bottom of the box (see FIGS. 3 and 4). (In FIG. 1, the stiffener appears wider than the box body because the body has not yet been unfolded into its final shape.)

Moreover, the stiffener is connected via its end panels 1 and 5 to two opposite sides of the box, this joining being achieved by an articulation, for example along the line b, b', marked in broken lines in FIG. 2. This articulation may be achieved, for example, as shown in FIG. 6, by means of a sheet of strong paper 6 bonded, respectively, on one side of the box and on the connected panel 1 or 5 of the stiffener.

It is clear from this description that, in order to convert the box body from its folded state, as shown in FIG. 1, to the state in which it is ready for use, shown in FIG. 4, the stiffener and the box body first have to be unfolded in order to place the assembly in the position shown in FIG. 2 and, then, by separating the two sides of the box which are perpendicular to the folding lines of the stiffener, the latter is engaged in the box as shown in FIG. 3. This engagement is completed so that the stiffener indeed matches and lines the bottom of the box while, by means of the two attachment articulations such as d, the two end panels 1 and 5 of the stiffener are pressed against the two sides C1 and C2 of the box body on which these panels are articulated and which include the folding lines a b, a', b' of the box body.

In this manner, a box body is obtained which has good shape stability and which is suitable for receiving the nestable lid A whose height is markedly smaller.

Provision may be made on each of the large sides of the stiffener for a small projection **3*a* which engages in a corresponding slot 3*b*** in the box body when the deployed stiffener is in place, so as to hold this stiffener.

One of the results achieved by the device described is, as has been stated, a very considerable reduction in storage volume.

In fact, in the folded state, the box body and its stiffener occupy a height which is less than the height of the lid and, as this height is generally approximately one third that of the box, it may be seen that the system makes it possible to reduce by two thirds the volume occupied during storage, for which purpose the folded box body may be completely covered by the lid.

It should be noted that, in the preceding description, the words "articulation" or "articulated" should be understood as relating either to a simple line where the material is thinned, as may be achieved, for example, with a knurling wheel, in order to permit folding, or to an assembly of two planes by means of bonded strips of strong paper 6, as in FIG. 6, or to any other equivalent means.

We claim:

1. A folding box made from a semi-rigid material, comprising a rectangular continuous bottom, two first side walls connected to the bottom by two first folding lines on opposite sides of said bottom, two second side walls connected to the bottom by two second folding lines placed on other opposite sides of said bottom, and further connected to said first side walls by third folding lines, each second side wall further having two fourth folding lines at angle of about 45° with respect to said third folding lines, said box being further provided with a foldable stiffener which comprises a central part which when the box is in use, is substantially superimposed over a major portion of the bottom and reinforces it, said central part consisting of a plurality of panels articulated together so that they can be folded down on one another or be juxtaposed to lie in the same plane when the box is unfolded, the stiffener further comprising two end panels articulated to opposite sides of the central part, each of said end panels when the box is unfolded, abutting against an inner surface of said second side wall, and having two edges, at least a portion of each edge abutting against said first side walls, and at least one of said end panels being also articulated to one of said second side walls.

2. Box according to claim 1, wherein the central part of the stiffener consists of a thick sheet having the same outer contour as the bottom of the box.

3. Box according to claim 1, wherein the end panels of the stiffener are connected to opposite sides of the box body which include folding lines of the box body.

4. Box according to claim 1, wherein projections are provided on the stiffener and slots are provided on the side walls, said projections being positioned to cooperate for maintaining in place the stiffener.

5. Box according to claim 1 which has, in the folded state, a height of a same order of magnitude as that of a nestable lid for the box.

6. A folding box as claimed in claim 1, wherein the end panel of the stiffener is articulated to said second side walls along a segment of said second side walls which separates upper ends of said fourth folding lines.

7. A folding box as claimed in claim 1, wherein each end panel of the stiffener is articulated to one of said second side walls of the box.

8. A folding box made from semi-rigid material comprising:

a rectangular continuous bottom having four walls connected to the bottom by first fold lines, said wall being moveable from a folded position where they overlie said bottom in planes substantially parallel to said bottom to an unfolded position where said walls are upstanding and substantially perpendicular to said bottom;

said four walls being interconnected at corners of the bottom by fold lines and two opposite walls having diagonal fold lines extending at about a 45° angle between adjacent walls;

a foldable stiffener overlying said bottom within said four walls and having a central part which, when the box is unfolded, is substantially superimposed over a major portion of said bottom so as to reinforce said bottom and, when the box is folded, said central part, which comprises a plurality of panels joined together by fold lines, is folded so that said panels overlie each other in planes generally parallel to said bottom;

said stiffener further comprising two end panels each having a first edge articulated to said central part and a second edge generally parallel thereto, at least one of said second edges being articulated to one of said walls so as to facilitate the corresponding end panel to abut against an inner surface of said one wall when the box is unfolded.

* * * * *